US009808697B2

(12) United States Patent
Dorsett

(10) Patent No.: US 9,808,697 B2
(45) Date of Patent: Nov. 7, 2017

(54) BOUNCE BACK ITEM NET

(71) Applicant: Dale Earnest Dorsett, Oakland, TN (US)

(72) Inventor: Dale Earnest Dorsett, Oakland, TN (US)

( * ) Notice: Subject to any disclaimer, the term of this patent is extended or adjusted under 35 U.S.C. 154(b) by 0 days.

(21) Appl. No.: 14/695,306

(22) Filed: Apr. 24, 2015

(65) Prior Publication Data

US 2015/0306483 A1 Oct. 29, 2015

Related U.S. Application Data

(60) Provisional application No. 61/995,911, filed on Apr. 24, 2014.

(51) Int. Cl.
*A63B 69/00* (2006.01)
*A63B 71/02* (2006.01)

(52) U.S. Cl.
CPC .... *A63B 69/0097* (2013.01); *A63B 2071/026* (2013.01); *A63B 2210/50* (2013.01)

(58) Field of Classification Search
CPC ..... A63B 69/0097; A63B 2210/50; A63B 2071/026
USPC ..... 473/434, 435
See application file for complete search history.

(56) References Cited

U.S. PATENT DOCUMENTS 3,427,026 A 2/1969 Mahoney
3,502,330 A * 3/1970 Cheftel ..... A63B 5/11 182/140
3,711,092 A * 1/1973 Hogue ..... A63B 69/0097 473/435
4,153,246 A 5/1979 Byrne
4,421,318 A * 12/1983 Sverdlik ..... A63B 69/0097 473/476
4,489,941 A * 12/1984 Shieh ..... A63B 71/022 273/395
4,553,751 A 11/1985 Ketchum
5,772,537 A * 6/1998 Anderson ..... A63B 69/0097 273/396
5,833,234 A * 11/1998 Vavala ..... A63B 69/0097 273/396
6,209,877 B1 4/2001 Warnick
6,250,634 B1 6/2001 Strain
6,299,554 B1 * 10/2001 Sinclair ..... A63B 63/00 473/421
6,357,750 B1 3/2002 Lievens
6,723,011 B1 4/2004 Helvert
6,739,988 B2 * 5/2004 Jensen ..... A63B 69/0002 273/396
7,264,245 B2 * 9/2007 Cho ..... A63B 69/0097 273/396
8,460,128 B2 6/2013 Elpers
8,540,592 B1 * 9/2013 Coppenrath ..... A63B 63/00 473/431

(Continued)

*Primary Examiner* — Joshua Kennedy

(57) ABSTRACT

This is the embodiment of the net apparatus used in sports and in the non-sports arenas. This net's frame supports an inner net framed matrix that connects and pivots a rear frame for an adjustable triangular-shaped lean to control the trajectory of the ball or object. The net is designed to rebound balls or objects with high energy even at side angles to return the ball to the sender. The net is also designed to minimize stress to both net and frame when a ball or object contacts the net.

1 Claim, 7 Drawing Sheets

(56) References Cited

U.S. PATENT DOCUMENTS

| | | | | |
|---|---|---|---|---|
| 8,590,901 | B2 * | 11/2013 | Goldwitz | A63B 63/00 273/395 |
| 8,651,979 | B2 * | 2/2014 | Chen | A63B 69/0097 473/422 |
| 9,227,126 | B2 * | 1/2016 | Christgau | A63B 69/0097 |
| 2004/0178585 | A1 * | 9/2004 | Cosenza | A63B 69/0002 273/454 |
| 2004/0180736 | A1 * | 9/2004 | Majumdar | A63B 69/0002 473/454 |

* cited by examiner

BOUNCE BACK ITEM NET

CROSS-REFERENCE TO RELATED APPLICATIONS

This application claims the benefit of provisional patent application Ser. No. 61/995,911, filed 2014 Apr. 25 by the present inventor.

The following is a tabulation of some prior art that presently appears relevant:

BACKGROUND OF INVENTION

U.S. Patents

| Patent Number | Kind Code | Issue Date | Patentee |
|---|---|---|---|
| 4,553,751 | | 1985 Nov. 19 | Ketchum |
| 6,209,877 | B1 | 2001 Apr. 3 | Warnick |
| 6,250,634 | B1 | 2001 Jun. 26 | Strain and Milligan |
| 6,357,750 | B1 | 2002 Mar. 19 | Lievens and Geert |
| 6,723,011 | B1 | 2004 Apr. 20 | Helvert and Bowden |
| 3,427,026 | | 1969 Feb. 11 | Mahoney |
| 4,153,246 | | 1979 May 8 | Byrne |
| 8,460,128 | A1 | 2013 Jun. 11 | Elpers |

Through history nets have been used for various purposes from catching fish, catching animals, catching planes landing on aircraft carriers, nets to strain food or catch debris, catching falling people or objects, to nets used in sports applications. Even though the embodiment of the Bounce Back Item Net is focused on applications in sports it could apply to many of other areas like safety, commercial, and industrial applications.

Focusing within the realm of sports, returning or rebounding balls has been done with reasonable results; however footballs have not worked well on any existing net until now. What is really lacking with existing types of rebounding nets is higher rebound energy, adaption to shapes of balls or other objects like oblong shaped footballs, and more control of where balls or other objects trajectories.

Several types of sports nets have been proposed—for example, in U.S. Pat. No. 4,553,751 to Ketchum (1985), U.S. Pat. No. 6,209,877 to Warnick (2001), U.S. Pat. No. 6,250,634 to Strain and Milligan (2001), U.S. Pat. No. 6,357,750 to Lievens and Geert (2002), U.S. Pat. No. 6,723,011 to Helvert and Bowden (2004), U.S. Pat. No. 3,427,026 to Mahoney (1969), U.S. Pat. No. 4,153,246 to Byrne (1979), U.S. Pat. No. 8,460,128 to Elpers (2013). Although various rebounding types of nets have been designed to work with sports balls, many limits have existed due to such factors as loss of energy for return, having to stand directly in front of the net to have the ball return towards the sender due to lack of control of where the ball rebounds, and of course the inability to handle footballs due to their oblong shape.

Dorsett patent Application 61/995,911(2014) for 'Bounce Back Item Net', henceforth called 'Dorsett', describes a net that has high rebound energy, can handle balls and objects despite unusual shapes, and has good control over where the ball rebounds or is directed to, which includes returning balls to senders at side angles<45 degrees. I do respect the existing patents and the cleverness of their designs. I perceive that they have the following strengths and weaknesses:

U.S. Pat. No. 4,553,751 by Ketchum, sports bouncing back apparatus, is designed for hockey pucks and not balls. Whereas Dorsett can be designed to rebound any object.

U.S. Pat. No. 6,209,877 to Warnick is a rebounding sports net designed to use a weave of perpendicular nylon strings held tightly on a flimsy frame. It is designed after a tennis racket which has very low rebound energy without swinging the racket. Whereas Dorsett easily rebounds various shaped balls or objects to the sender or source with accuracy and high energy.

U.S. Pat. No. 6,250,634 by Strain and Milligan improved sports bounce back apparatus is lighter weight than the present design by Dorsett, inexpensive to manufacture, durable and resistant to weather but limited to round soccer sized balls which when propelled hard against the device may rebound or bounce back to the user, especially standing in front of it. Whereas Dorsett is capable of easily rebounding assorted sports balls, irregular balls like footballs or other objects, has more control of the ball or object, can rebound balls even at side angles, and the rebound energy is probably much higher.

U.S. Pat. No. 6,357,750 by Lievens and Geert has a device comprising a frame, a net, and an elastic suspension element which gives it some rebound capability. However the net is more designed for tennis and round balls. Whereas Dorsett overcomes the ball rebound limitations by providing high rebound energy, rebounds even at a side angle, more control, and can rebound unusual objects like oblong footballs.

U.S. Pat. No. 6,723,011 by Helvert and Bowden has a catch net device consisting of a net, and a mesh which are standard in structure for application with soccer balls. Net replacement is an additional feature. Whereas, Dorsett will rebound the balls or objects, instead of stopping them.

U.S. Pat. No. 3,427,026 A by Mahoney sets on a square mount structure with the rebounding type net which is raised to an adjustable height and lean to rebound at the select height. The rebounding net is essentially a firm net connected to the net frame on the net edge by elastic materials, similar to materials on some trampolines. Whereas Dorsett provides much higher rebound energy, better control of where balls are rebounded to, and handles round or odd shaped balls or objects.

U.S. Pat. No. 4,153,246 by Byrne has a device that essentially is a tough sheet that can be mounted to garage doorways or fixed structures that acts as a stop for assorted balls. Whereas Dorsett rebounds balls and other objects of various shapes with control of trajectory by the sender, or source, rebounding such with high energy.

U.S. Pat. No. 8,460,128 by Elpers has a device that is multifaceted and complex in structure. Essentially, it is a stop surface for balls but has some rebound energy in one of its many layers of structure using a taut net attached to the frame by elastic stretchable cord on the edge. This rebounds with low energy and control. Whereas Dorsett rebounds balls or other shaped objects with high energy, provides control to the sender, or source, of where the ball or object goes, and can rebound balls or objects of various shapes to its origin even from side angles.

SUMMARY

In accordance to the embodiment of a uniquely designed net comprising a special capability to actually capture a ball or object's shape and direction, even from side angles, and rebound it to sender or redirect it to a different direction with great control, optimal energy, and minimal strain on the net and net mounting.

Advantages

Accordingly several advantages of this are as follows: a net matrix that adapts to the shape of the sports ball or other objects; a net matrix that adapts to the direction of the sports ball or object; reduced stress on net and frame from impact of sports ball or object resulting in extended life of net and frame; highly accurate control of where ball or object goes; minimal loss of impact energy resulting in higher rebound energy; and rebound object to sender even at side angles.

DRAWINGS

Figures

REFERENCE NUMERALS

10 Net Support Frames
11 Net Matrix
12 Inner Frame Net Support Structure
13 Front Vertical Frame Component
14 Rear Vertical Frame Component
15 Front Top Horizontal Frame Component
16 Rear Top Horizontal Frame Component
17 Front Bottom Horizontal Frame Component; Identical/opposite to 18 but not shown
18 Rear Bottom Horizontal Frame Component
19 Frame Elbow Joint
20 Bumper Pad Assembly
21 Net Cord
22 Net Tie Point Device
23 Pivot Device
24 Inner Frame Mounting Bar
25 Mounting Standoff
26 Mounting Hex-Head Bolt
27 Small Mounting Roundhead Bolt
29 Corner Net Mount And Brace
30 Net Crimp/Holder
31 Net Mounting Hole
32 Anti-Skid Feet
33 Washer
34 Frame Hex Head Bolt
35 Frame Nut
36 Lock Washer
37 Vinyl Tape or Covering
38 Bumper Mounting Base
39 Firm Foam Padding

DETAILED DESCRIPTION

FIGS. 1, 2, 2A, 3, 4, 5

Figure 1:
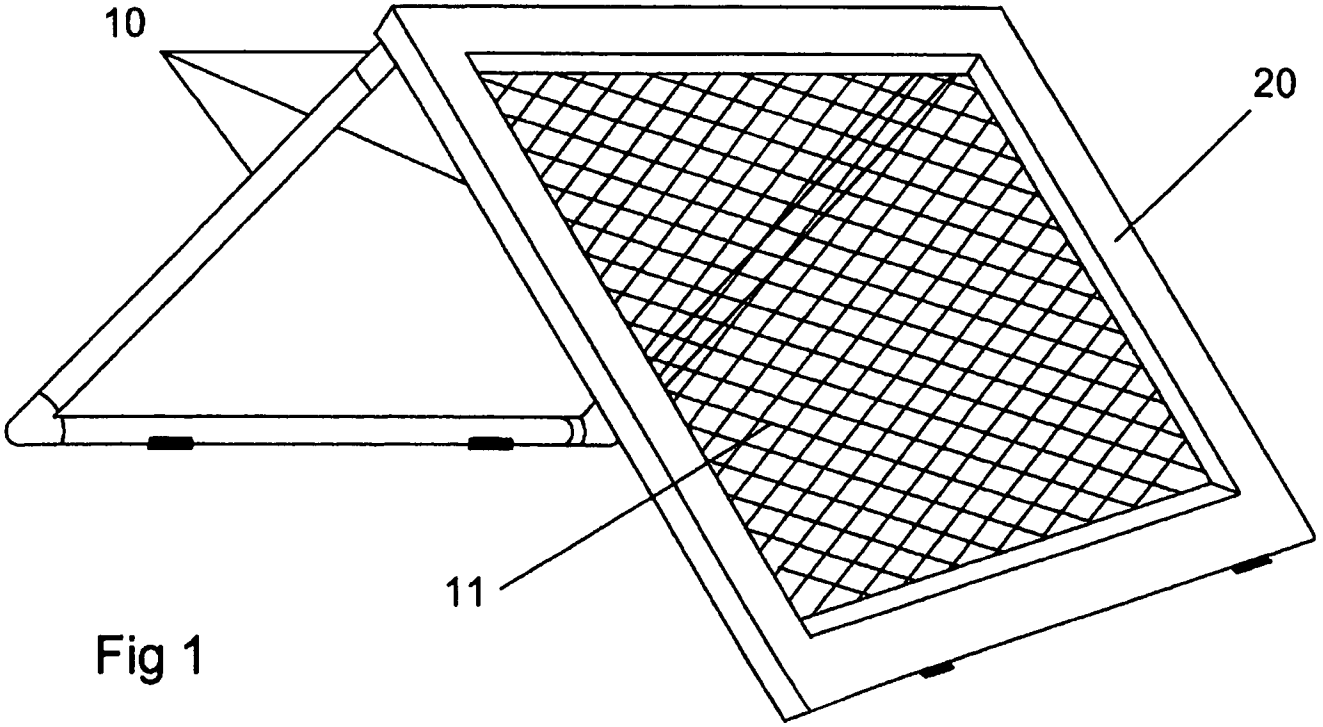
FIG. 1 is a perspective view taken towards the left-front side of the sports net rebound apparatus showing the 'A' shaped frame structure in accordance with the invention, and revealing the basic design of the sports net application.

FIG. 1 is the left-front side perspective view of the sports net rebound apparatus showing the complete A shaped Net Support Frames 10 as freely providing an adjustable angular lean of the net if standing on a ground plane. Said frames join and pivot at the top of the net, see FIG. 3 item 23, for either collapsing for portable storage or standing at an angularly adjustable A shape for usage on a relatively flat surface. Said net can be mounted on raised extension legs at a more vertical position or mounted on other platforms for various uses. FIG. 1 reveals the front bumper pad 20 which protects edges of the net that are susceptible to possible damage. The key embodiment in Net Matrix 11 reveals a diamond shaped cross hatch pattern which seems to work better for capturing and rebounding footballs, or other objects than a 'checkered square' shaped matrix does.

Figure 2:
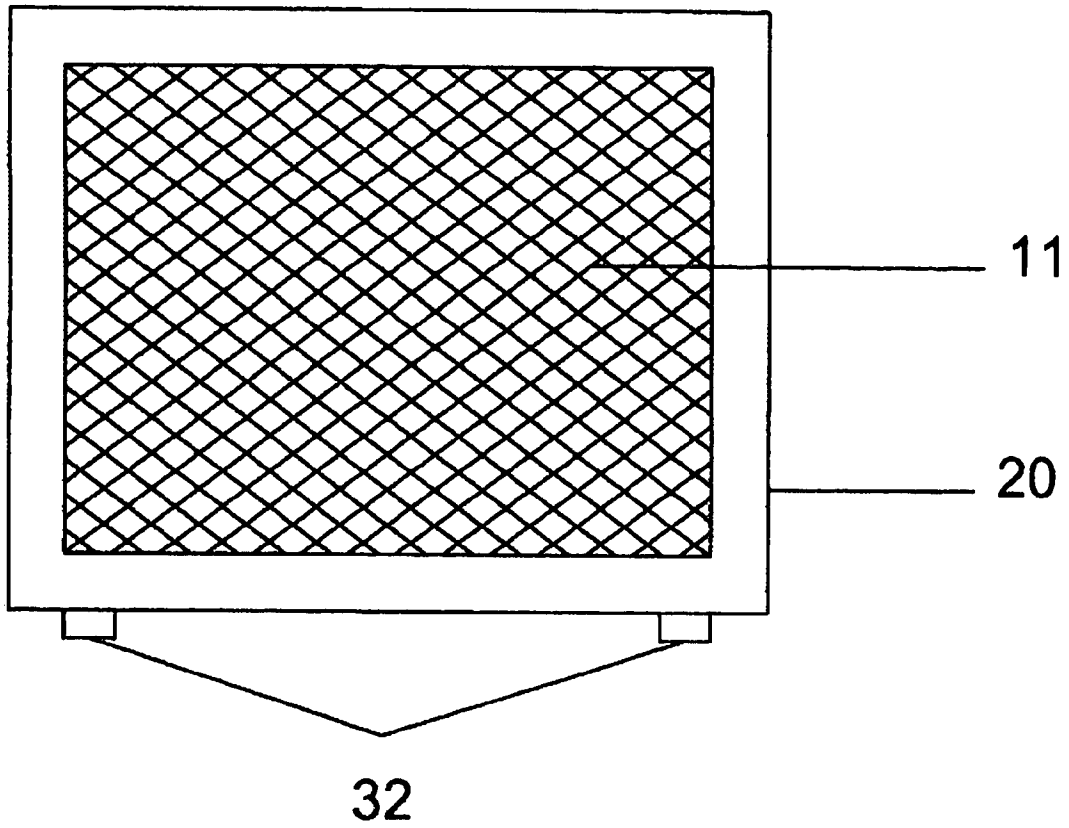
FIG. 2 shows the view of the sports net rebound apparatus of FIG. 1.

FIG. 2 is a front view of the sports net rebound apparatus showing the Net Matrix 11 and Bumper Pad 20 which covers the frame and edge mounting of the Net Matrix 11 in order to protect said Matrix at the weakest points on the edge mounting. Also revealed is the Anti-Skid Feet 32 to prevent movement of the Bounce Back Item Net.

Figure 2A:
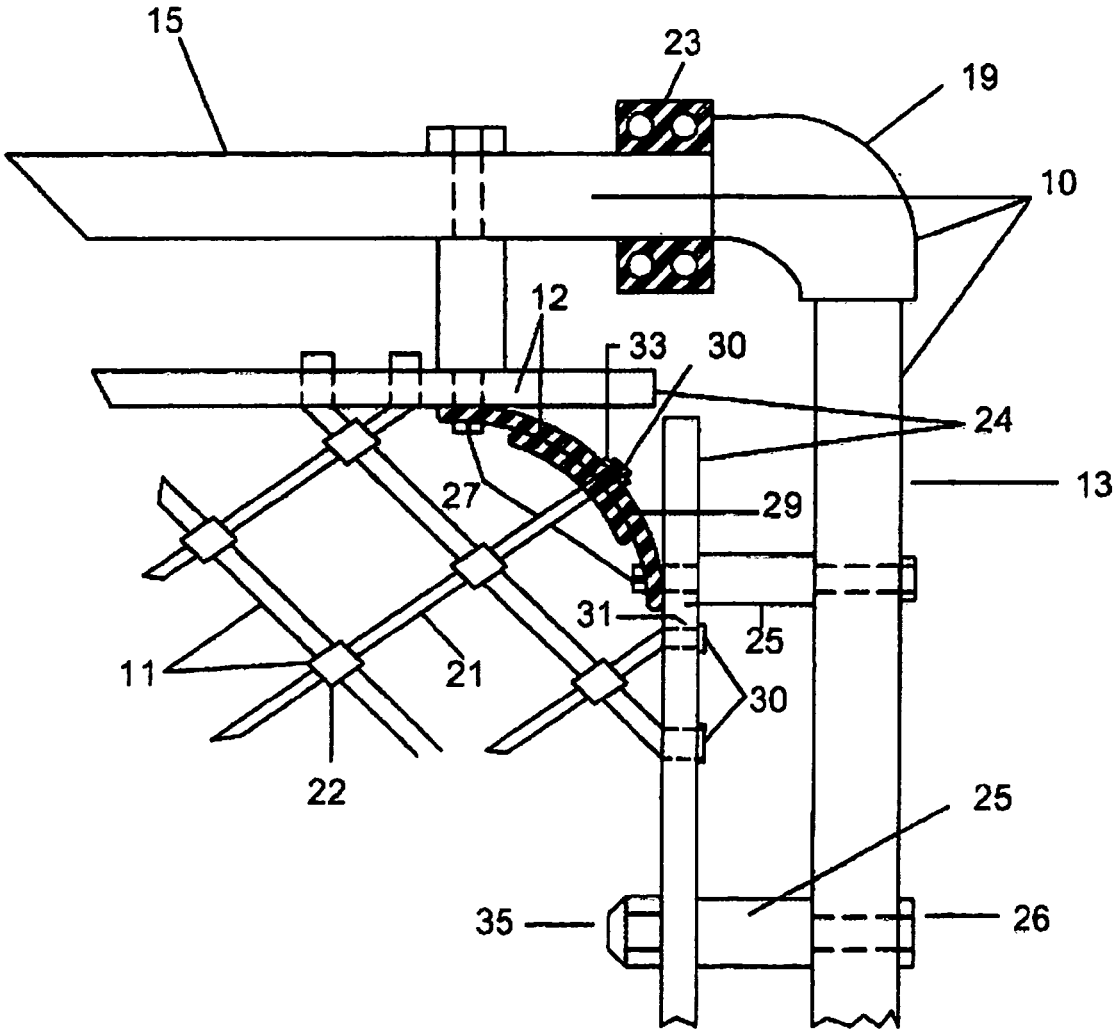
FIG. 2A shows the front view of FIG. 2 of the net without the bumper pad assembly 20 with focus on a corner to reveal net and frame construction and thus the heart of the Bounce Back Item Net.

FIG. 2A is a front view of the Bounce Back Item Net without the Bumper Pad, see FIG. 1 Item 20, illustrating a net corner, symbolic of other corners, which reveals the Net Matrix 11 mounted to Inner Frames Net Support Structure 12 which is comprised of Corner Net Mount and Brace 29 secured to Inner Frame Mounting Bars 24 by Small Mounting Roundhead Bolts 27. Said Inner Frames Net Support Structure 12 is mounted to the outer front Net Support Frame 10 by Mounting Standoffs 25, Mounting Hex-Head Bolt 26 to Net Support Frame 10 by Frame Locknut 35. FIG. 2A clearly shows the outer front Net Support Frame 10 elements consisting of Front Vertical Frame Component 13 attached to the Front Top Horizontal Frame Component 15 by a Frame Elbow Joint 19. Identical structure exists on other 3 corners. Net Matrix 11 elements consist of select elastic Net Cords 21 and Net Tie Point Devices 22 which secure cords together at diagonal cross points locking in the cord matrix to prevent passage of an object through the net which allows capturing the angular momentum of a ball or object so that rebound to the sender or where the object came for rebound return. Net Cord 21 is mounted through Net Mounting Holes 31 in the Inner Frame Mounting Bars 24 and Corner Net Mount and Brace 29 and is secured in place on each end of Net Cord 21 using Net Crimp/Holders 30.

Figure 3:
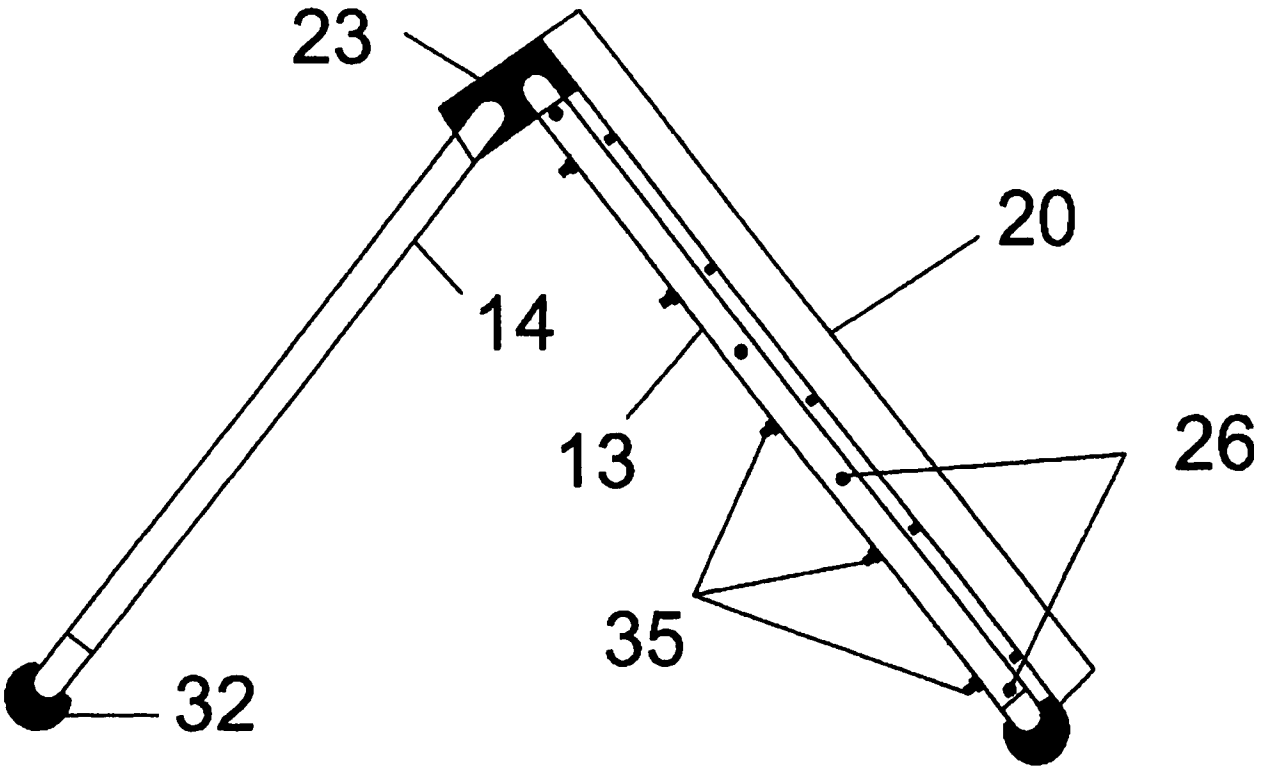
FIG. 3 shows the left view of the sports net rebound apparatus of FIG. 1. The right view is a mirror of the left view.

FIG. 3 is the left side view of the sports net rebound apparatus which reveals Rear Vertical Frame Component 14, Pivot Device 23, Front Vertical Frame Component 13 with Bumper Pad 20 mounted by Frame Locknuts 35 to said frame. Also revealed are Mounting Hex-Head Bolts 26 are which secures the Inner Frame Mounting Support Structure 12 to Front Vertical outer Frame Component 13, as shown in FIG. 2A.

Figure 4:
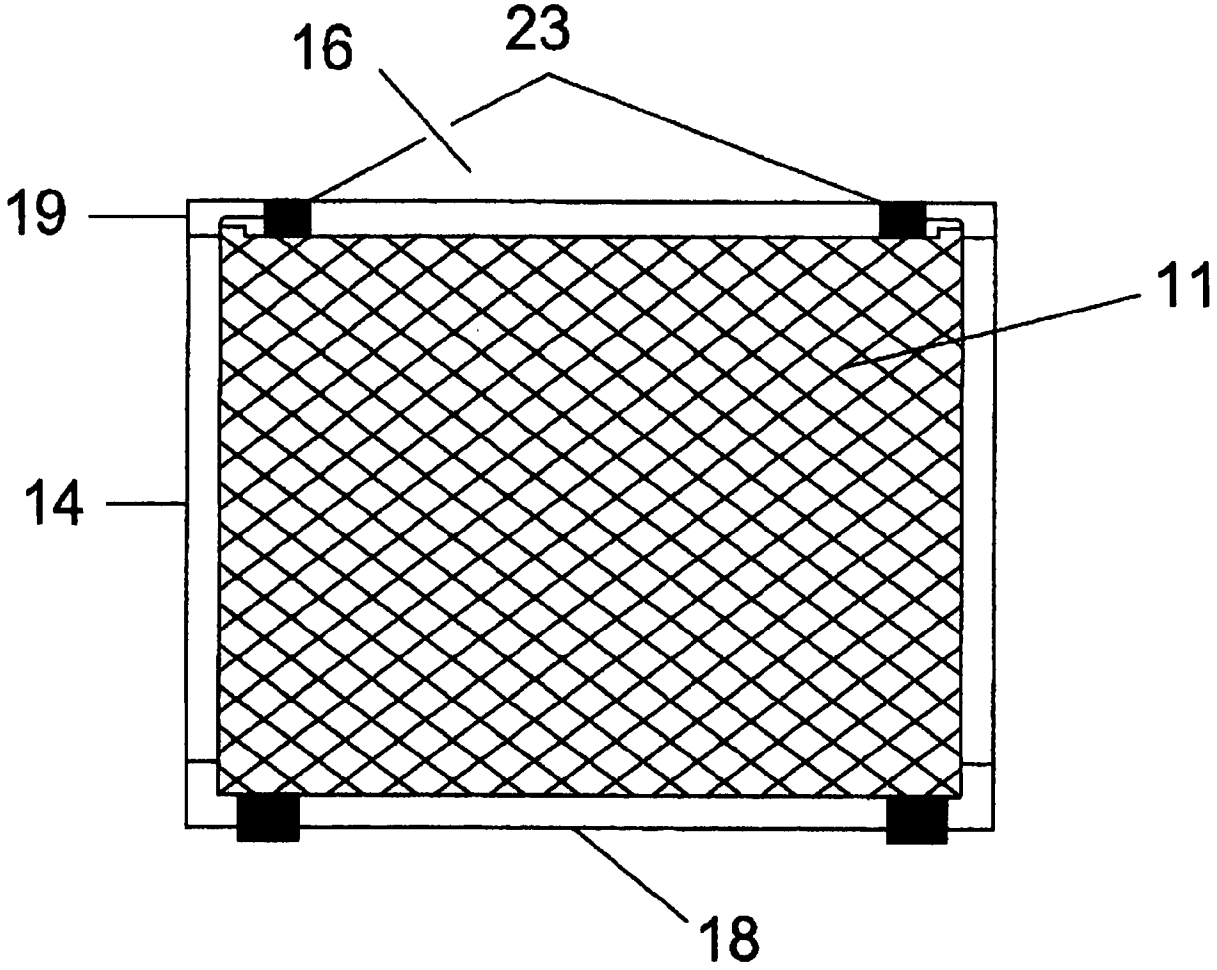
FIG. 4 shows the rear view of the sports net rebound apparatus of FIG. 1.

FIG. 4 is the back view of the sports net rebound apparatus showing top Pivot Devices 23, Net Matrix 11, Rear Vertical Frame Component 14, Rear Top Horizontal Frame Component 16, Rear Bottom Frame Component 18, and the back side of Bumper Pad Assembly 20. not show on back side view.

Figure 5:
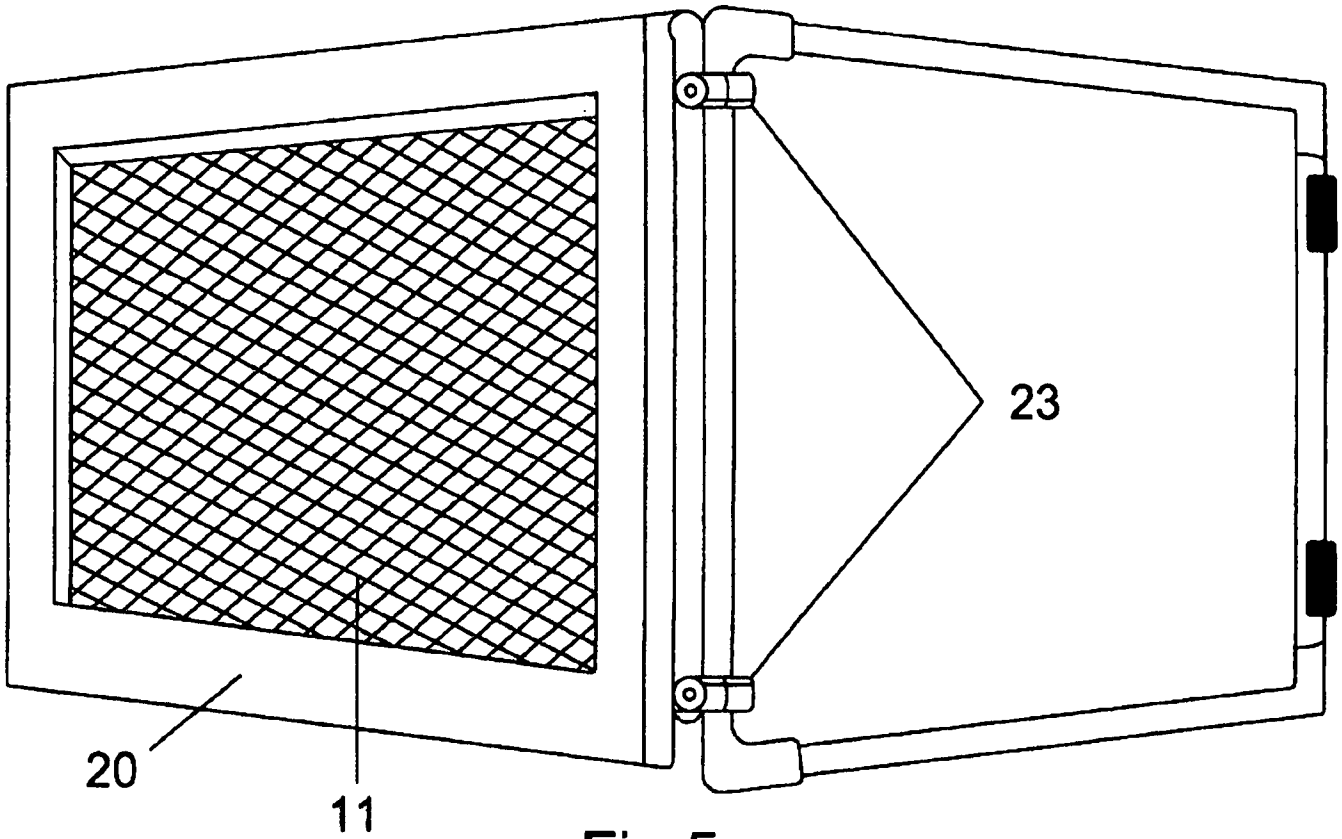
FIG. 5 shows the top view of the sports net rebound apparatus of FIG. 1.

FIG. 5 is the top view of the Bounce Back Item Net which clearly shows the Bumper Pad 20, Net Matrix 11, and top Pivot Device 23.

FIG. 1A

Additional Embodiment

Figure 1A:
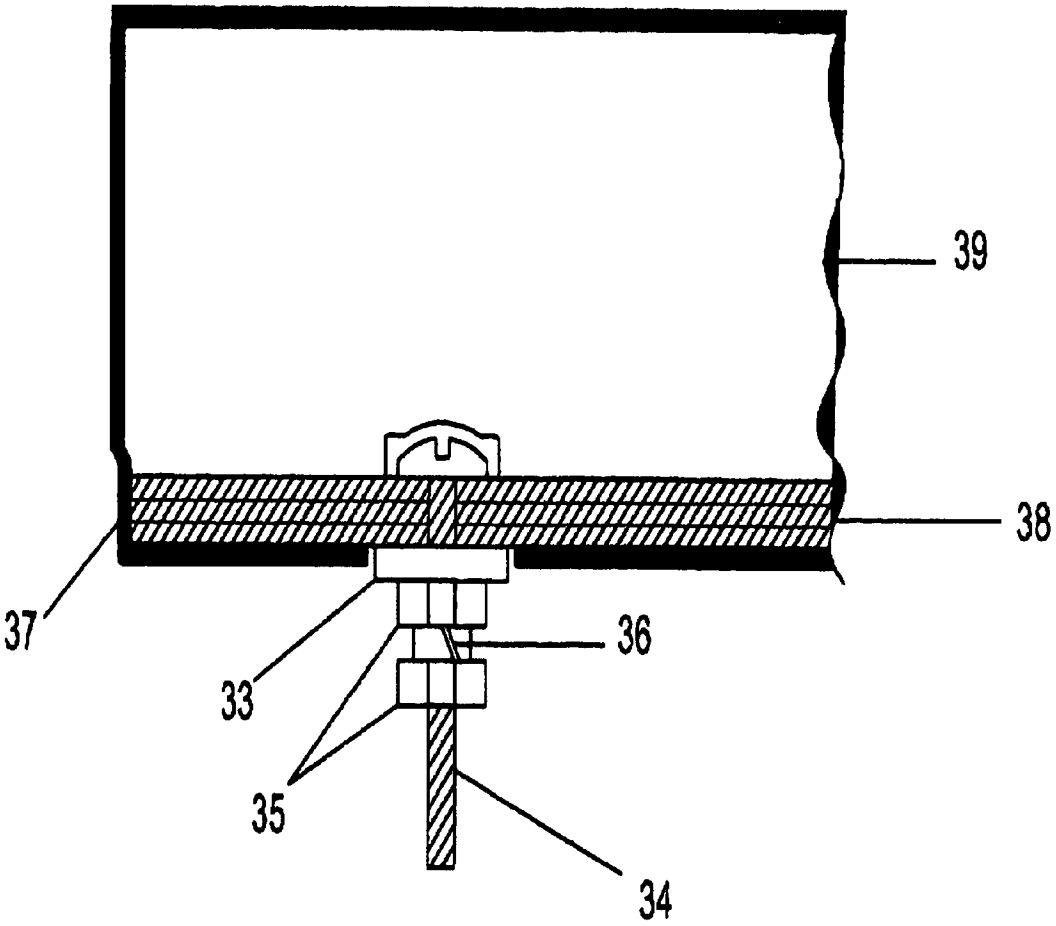
FIG. 1A shows a cutaway view of the protective bumper pad assembly shown in FIG. 1.

FIG. 1A is the side cutaway view of the Bumper Pad Assembly 20, shown in FIG. 1, revealing construction components starting with Vinyl Tape or Covering 37 enclosing said Assembly comprised of Firm Foam Padding 39, Bumper Mounting Base 38, Frame Hex Head Bolt 34, for mounting to outer front Net Support Frame 10 as shown in FIG. 3, Frame Nuts 35, Washer 33, and Lock Washer 36.

Advantages

From the description above, a number of advantages of some embodiments of my Bounce Back Item Net become evident:

(a) Both front and back frame net support structures give strength, stamina, and flexibility to either adjust the leaning angle for usage or to flatten for storage.

(b) The unique anti-skid feet help prevent movement from impact by balls or objects.

(c) The front bumper pad protects edges of the net matrix from damage extending net life.

(d) The unique net matrix is diamond shaped for optimal catching of balls, especially footballs. Various reticulated designs could be utilized for unique objects.

(e) The unique net matrix design provides a high energy rebound of the object with little loss because the net absorbs most energy laterally reducing stress and loss of energy to the net frames by captures and holds impact energy efficiently thus limiting loss of energy and allowing optimal rebound of energy, such energy as is trapped in the cords themselves.

(f) Can provide angular rebounds of balls or objects up to sender or from where it came are of up to about 45 degrees to either side from front and center.

(g) Provides very accurate control of where a ball or object is sent.

(h) Provides minimal stress on the net matrix as well as the mounting framework provides longer life of the net, mounting structure, and of the ball or object.

CONCLUSION, RAMIFICATIONS, AND SCOPE

This net is specially tailored for the oblong shaped footballs but not limited to oblong shapes etc. This net rebound direction can be controlled by the user-or sender in the vector or direction, where—the object is to be rebounded to. This net will rebound with minimal energy loss, controlled direction, rebounding in a uniform distance, and with an approximately identical force. This should not be limited to footballs or even sports balls but can have applications that go much further.

Although the description above contains many specificities, these should not be construed as limiting the scope of the embodiments but as merely providing illustrations of some of the several embodiment's capabilities. As specified, this should not be limited to football or even sports but can have applications that go much further. The net matrix is shown as a diagonal diamond shaped pattern but the principles laid out can be used in different patterns like a square reticulated pattern, etc. The distance between cords and the tension of the cords can be changed for various applications. This structure could be knit, eliminating the need for tying cross points but may not work so efficiently for sports applications, especially footballs, but would probably work in many other applications, especially if coated with an elastic material similar to the modulus of the cords—stabilizing positions to absorb 'vector energy' and rebound it back where it came from.

I claim:

1. A bounce back net comprising:

a polygonal front frame component defined by a plurality of frame supports and pivotally connected to a rear frame component configured to provide an adjustable angular lean of the net to control angular directivity;

an inner frame net support structure comprising inner frame mounting bars interiorly spaced from respective frame supports of said plurality of frame supports of said front frame component by rigid mounting standoffs; each of said inner frame mounting bars being joined to an adjacent inner frame mounting bar with a corner net mount and brace;

a net matrix comprising elastic net cords secured together at diagonal cross points in a diamond shaped cross hatch pattern with net tie point devices to absorb impact energy, laterally reducing structural stress and to optimize return energy; each end of each of said elastic net cords are mounted through net mounting holes in a respective one of said inner frame mounting bars or in a respective one of said corner net mounts; said elastic net cord ends are secured in place using net crimp holders;

wherein said net is configured to prevent passage of an object through said net matrix and said net matrix has a tension configured to allow capturing of angular momentum and assume shape of the object to rebound to the sender in the direction from which the object came.

* * * * *